US007600997B2

(12) United States Patent
Nolte et al.

(10) Patent No.: US 7,600,997 B2
(45) Date of Patent: Oct. 13, 2009

(54) METHOD FOR INCREASING THE THROUGHPUT OF PACKAGES IN ROTARY TUBULAR KILN APPARATUS

(75) Inventors: Michael Nolte, Goslar (DE); Bernhard Oser, Karlsruhe (DE); Mark Eberhard, Karlsruhe (DE); Thomas Kolb, Edenkoben (DE); Helmut Seifert, Ludwigshafen (DE); Rolf Kerbe, Weingarten (DE); Hubert Gramling, Graben-Neudorf (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 107 days.

(21) Appl. No.: 11/879,002

(22) Filed: Jul. 13, 2007

(65) Prior Publication Data

US 2007/0264604 A1 Nov. 15, 2007

Related U.S. Application Data

(63) Continuation-in-part of application No. PCT/EP2006/001459, filed on Feb. 17, 2006.

(30) Foreign Application Priority Data

Feb. 26, 2005 (DE) ..... 10 2005 008 893

(51) Int. Cl.
*F27B 9/40* (2006.01)

(52) U.S. Cl. ..... 432/37; 432/112; 432/239

(58) Field of Classification Search ..... 432/67, 432/72, 86, 106, 124, 235, 243, 130, 133
See application file for complete search history.

(56) References Cited

U.S. PATENT DOCUMENTS

| | | | | |
|---|---|---|---|---|
| 4,022,569 | A * | 5/1977 | Farago et al. | 432/14 |
| 4,435,149 | A * | 3/1984 | Astheimer | 431/12 |
| 4,716,532 | A * | 12/1987 | Benoit et al. | 700/207 |
| 4,782,766 | A | 11/1988 | Lee et al. | |
| 4,861,262 | A | 8/1989 | Gitman | |
| 5,176,086 | A * | 1/1993 | Clark et al. | 110/346 |
| 5,207,176 | A * | 5/1993 | Morhard et al. | 110/246 |
| 5,711,018 | A * | 1/1998 | Hittner et al. | 588/314 |
| 6,168,419 | B1 * | 1/2001 | Mindermann | 431/79 |

FOREIGN PATENT DOCUMENTS

| | | | |
|---|---|---|---|
| DE | 42 24 571 | A1 | 1/1994 |
| DE | 10055832 | A1 * | 5/2002 |
| EP | 0 990 847 | A1 | 10/1999 |

* cited by examiner

*Primary Examiner*—Daniel G. DePumpo
*Assistant Examiner*—Robert E Thomas
(74) *Attorney, Agent, or Firm*—Klaus J. Bach

(57) ABSTRACT

In a method for increasing the throughput of packages of waste material of a high caloric value of rotary kiln plants which include a rotary tube with a combustion chamber and a post combustion chamber to which the combustion gases from the rotary tube are supplied and which includes at least one burner supplied by gas from a gas supply, the waste packages are supplied to the rotary tube and burned therein with oxygen containing gas and the combustion gas flows to the post combustion chamber for post combustion, the combustion process being continuously monitored in the kiln and the post combustion chamber and controlled by adjustment of the combustion conditions in the kiln and the post combustion chamber.

9 Claims, 4 Drawing Sheets

METHOD FOR INCREASING THE THROUGHPUT OF PACKAGES IN ROTARY TUBULAR KILN APPARATUS

This is a Continuation-In-Part Application of international Application PCT/EP2006/001459 filed Feb. 17, 2006 and claiming the priority of German application 10 2005 008 893.7 filed Feb. 26, 2005.

BACKGROUND OF THE INVENTION

The invention resides in a method for increasing the throughput of packages in rotary kiln waste material combustion plants which are generally tubular chambers rotating about an axis of symmetry (motor driven rotary tube). At one end, the rotating tube opens into a post combustion chamber leading to an exhaust gas channel and at the other end fuel is supplied by burners, nozzles and solid material transport devices. By way of the solid material transport devices, packages of (liquid high caloric) waste material is discontinuously added and burnt in the rotary kiln. Rotary kilns are particularly used for the combustion of heterogeneous combustible materials such as industrial waste and particularly waste materials, which need to be monitored.

The gas phase combustion process area of a combustion plant is determined essentially by conditions such as residence time, temperature and mixing as well as stoichiometry. Without optimizing the combustion process by these values, already in the combustion space strands of excess air flows as well as areas with local air deficiencies can form so that the oxygen content varies highly locally and also with time. The mixing (turbulence) influences herein mainly the formation of local strands, the transient combustion in connection with packages because of the stoichiometry ($O_2$ supply) the formation of time-variable strands. Both ways of forming strands lead to a non-uniform and incomplete combustion in the combustion space and result in the emission of noxious materials (CO). Particularly the CO content serves as an indicator for the combustion quality.

The formation of time-variable strands in the combustion space is particularly problematic in connection with the combustion of packages in rotary kilns since the packages are supplied discontinuously. When a package is supplied by the transport device to the combustion space of the rotary kiln, the package opens up more or less suddenly—depending on the calorie content. With the thermal conversion of the suddenly released high-caloric content of a package, the thermal rotary kiln loading is suddenly highly increased and the available oxygen amount is locally much reduced.

But also other exhaust gas species concentrations such as moisture ($H_2O$), carbon dioxide ($CO_2$) or carbon monoxide (CO) change suddenly with the combustion of packaged material. As a result, because of the combustion-based oxygen consumption, also substantial amounts of unburned hydrocarbons, soot and particularly CO (as concentration peaks) are formed in the rotary kiln, which cannot be fully eliminated in the post combustion chamber even with the use of burners. Subsequently, the noxious compounds pass through the plant including the exhaust gas cleaning equipment almost uninhibitedly and are discharged via the chimney into the atmosphere.

Since all waste combustion plants are subjected to tight emission limits, the CO-concentration at the exhaust duct is, based on the half hour average or, respectively, the day average, the limiting factor for the combustion of packages in the rotary kiln (half hour average value: 100 mg/Nm$^3$ CO, day average value: 50 mg/Nm$^3$ in accordance with BImSchV).

It is known that, for reducing the CO formation during the combustion of packages, highly over-stoichiometric air amounts are supplied to the rotary kiln, in order to accommodate the fuel release peaks in the form of soot, organic C and CO (influencing the stoichiometry by increasing the combustion air amount). Since the exhaust gas volume flow is normally capacity limiting the waste flow is substantially reduced by this procedure. The excess air flow which is highly over-stoichiometric and has a cooling effect in the kiln additionally results in lower combustion temperatures and consequently to a deterioration of the reaction conditions in the combustion space.

It is also known to influence the stoichiometry of the combustion of packaged waste by the addition of oxygen enriched combustion air or the addition of oxygen by way of separate nozzles in such a way that an increased flow of waste in the form of packages is possible. By substituting combustion air by oxygen-enriched air or, respectively, by the addition of oxygen to the combustion process, first the stoichiometry ($O_2$ supply) is substantially increased, while the temperature and exhaust gas volume flow remain essentially constant.

With increased supply of high caloric packages, the overall stoichiometry ($O_2$ supply) drops again whereas the exhaust gas volume remains essentially constant. With the increase of the oxygen content in the combustion air, the combustion temperature in the rotary kiln is increased while the exhaust gas volume remains the same, since the amount of ballast air (air nitrogen) is reduced and must not be heated to the combustion temperature. An increased combustion temperature again leads to an increased temperature load in the combustion chamber of the rotary kiln (melting of the slack deposits). Another disadvantage with the use of oxygen-enriched combustion air or additional oxygen injection into the combustion chamber is the economic viability resulting from the increase in expenses by the oxygen enrichment and the safety considerations.

A separate control of the fuel-air ratio of individual gas and oil burners on the basis of signals of optical sensors is also known.

DE 100 55 832 A1 discloses such a control of the fuel-combustion air-mixture of oil and gas burners on the basis of photo sensors which monitor optically the flame radiation.

DE 197 46 786 C2 further discloses an optical flame monitor with two semiconductor detectors for oil and gas burners for the monitoring of the flames and the control of the fuel-air ratio or, respectively, the fuel supply, wherein the spectral distribution of the flame radiation is used as the input signal for the control.

DE 196 50 972 C2 also includes such a control for monitoring and controlling the combustion process by measuring the radiation by sensor-based detection of a narrow—as well as wide-band spectral range of a flame. The purpose is to maintain of high combustion efficiency and, at the same time minimal toxic emissions.

The cited state of the art however comprises only solutions for particular single problems with respect to the adjustment of individual oil or gas burners and not for the control of the overall process of a combustion plant (rotary kiln).

In order to achieve a substantial improvement in the plant efficiency by optimizing the rotary kiln/post combustion operating procedure, a rapid (and simultaneous) determination of the values defining the combustion procedure in the rotary kiln (CO, soot, $O_2$, $CO_2$, or $H_2O$) is necessary. Conventional sensors, or, respectively, sampling procedures, wherein exhaust gas is drawn from the process result in long response times.

These monitoring procedures are not suitable to determine the incomplete combustion (for example, by way of concentration changes of individual species such as soot, CO, $O_2$, $H_2O$ or $CO_2$) in the rotary kiln sufficiently rapidly. For a rapid control of the combustion process, an in-situ determination of the combustion-relevant species such as $O_2$, $CO_2$, $H_2O$, CO or soot (optical measurement procedures) in the combustion space with short response times ($t_{Antwort} << t_{Reaction}$) and high selectivity is necessary. If the detection of these components is too slow, the products of an incomplete combustion cannot be fully decomposed in the rotary kiln by appropriate procedures. The speed with which the concentration peaks move through the plant and the corresponding necessary reaction time of the control process depend on the plant material flow.

It is the object of the present invention to increase the processing capacity for high caloric packages in rotary kilns of the type referred to above while maintaining emission limits without the limitations described above.

SUMMARY OF THE INVENTION

In a method for increasing the throughput of packages of waste material of a high caloric value of rotary kiln plants which include a rotary tube with a combustion chamber and a post combustion chamber to which the combustion gases from the rotary tube are supplied and which includes at least one burner supplied by gas from a gas supply, the waste packages are supplied to the rotary tube and burned therein with oxygen containing gas and the combustion gas flows to the post combustion chamber for post combustion, the combustion process being continuously monitored in the kiln and the post combustion chamber and controlled by adjustment of the combustion conditions in the kiln and the post combustion chamber.

The invention comprises an overall concept for a combustion plant (rotary kiln) wherein in-situ measuring techniques (optical measuring techniques such as photodiodes, IR camera, laser . . . ) are used for a rapid detection (short response times) of an incomplete combustion in the rotary kiln. In this way in particular discontinuously occurring soot- or carbon oxide concentration peaks (in the rotary kiln) are recognized early. The measurement signals are used to control the burners in the rotary kiln and the post combustion chamber, which then adjust the combustion conditions (stoichiometry and mixing impulses) in the rotary kiln and the post combustion chamber to the requirements of a complete burn-out of the packages. The control comprises a control at the fuel supply side (stoichiometry) via the burners as well as a control of the air side (mixing impulse, stoichiometry) via the burners and the chute or nozzles.

In contrast to the techniques involving oxygen enrichment however the stoichiometry is not influenced by the air-oxygen supply control but by the fuel supply (short-term reduction of the fuel supply to the burners of the combustion chambers of the rotary kiln and the post combustion chamber). For optimizing the fuel-oxygen ratio, an additional secondary control of the air supply/air distribution (a combined air/fuel supply may be employed if the reduction of the fuel supply to the burners is insufficient for the reduction of the CO amount formed in the rotary kiln during the combustion of the packages (emission limit values).

The advantage of this procedure resides in achieving, by optimizing the fuel/air air amount and the distribution thereof in the rotary kiln and the post combustion chamber, a substantial increase of the package flow through the rotary kiln without incurring the problems concerning the gas phase combustion and, respectively, toxic emissions (CO). The exhaust gas volume flow is not increased in the process and the exhaust gas purification is not additionally strained.

The control arrangement of the burners in the post combustion chamber of a rotary kiln for the reduction of the CO amount formed during the combustion of packages has already been tested in a semi-industrial research plant "THERESA". In the first operational tests, a noticeable reduction of the CO concentration in the exhaust gas could be achieved and consequently the flow of packages through the rotary kiln could be substantially increased.

Below, the invention will be described on the basis of the accompanying drawings. The features described herein should be considered to be exemplary only.

DESCRIPTION OF PREFERRED EMBODIMENTS

Figure 1:
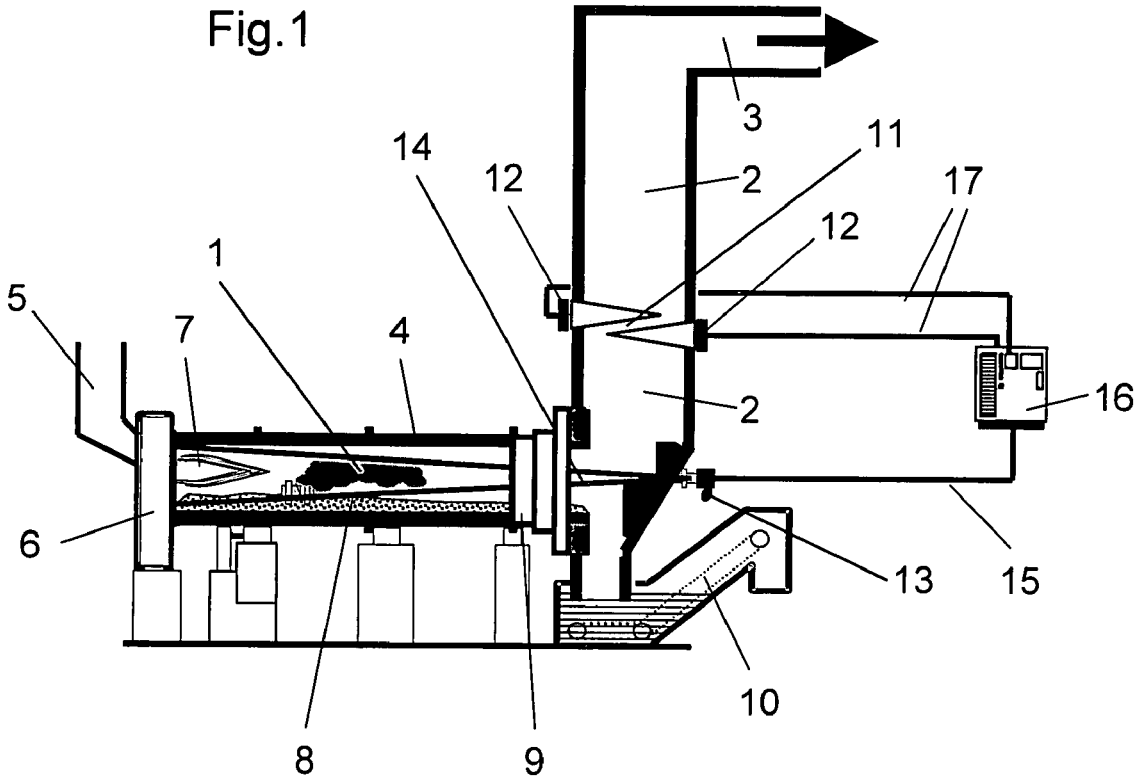
FIG. 1 shows, in principle, the design of a rotary kiln based on the semi-technical research plant THERESA.

FIG. 1 shows the arrangement of a rotary kiln installation in the research plant THERESA (Thermal plant for the combustion of special waste materials) of the Forschungszentrum Karlsruhe, Germany. It shows the whole combustion plant including a rotary tube 4 forming a combustion chamber 1 for the combustion of solid and paste-like materials, including packages, a post combustion chamber 2 for ensuring the full gas phase combustion and a flue 3 for conducting the exhaust gases to a boiler and also the exhaust gas purification devices which are both not shown in FIG. 1. The rotary tube 4 is driven by a motor. The packages and other solid materials are supplied via a water-cooled chute 5 disposed at the front end 6 of the rotary kiln together with part of the combustion air. For the combustion of combustible liquids and gases a rotary tube burner is disposed at the front wall of the rotary tube 6, to which the other part of the combustion air is supplied (see burner flame 7). The solid and paste-like combustible materials including the packages are burned in the combustion chamber (rotary tube). The residence time of the material in the combustion chamber is determined by the rotation movement and the inclination of the rotary tube. The combustion residues 8 are dropped at the end of the rotary tube 9 onto a liquid-submersed conveyor 10 and discharged to a slag trough (not shown in FIG. 1).

The packages introduced into the combustion chamber via the chute burn in the rotary tube and the combustion gases—partially only insufficiently combusted—leave the rotary tube 9 to the post combustion chamber 2. Complete combustion occurs in the post combustion chamber 9 in the effective range 11 of the two post-combustion chamber burners 12. The post combustion chamber burners 12 make the addition of combustible liquids and gases and also of combustion air possible.

In accordance with the invention, an optical in situ measurement of the combustion progress in the rotary tube, that is in the combustion chamber, is provided. In the exemplary embodiment, an optical sensor is used as the sensor unit 13. In contrast to the standard installation of an optical surveillance unit, the sensor was not installed after the burner but opposite the rotary tube burner. This arrangement provides for monitoring of the combustion chamber in the rotary tube and at the lower end of the post combustion chamber. Ideally, the sensor unit 13 is arranged in the lower area of the post combustion chamber in an axial extension of the rotary tube (see FIG. 1), wherein the radiation path 14 of the sensor fully covers the combustion chamber 1. Advantageously, the sensor unit 13 is disposed outside a combustion or post-combustion and also outside a direct flow of the combustion gases, for example, at the end of a dust area (trough or tube). In this way, the chances of contamination for example by soot deposits are effectively reduced.

The sensor unit 13 monitors the combustion progress and transmits the information as measuring signal 15 to the process control unit 16. In the process control unit 16, the measuring signal is analyzed to determine a toxic content of the combustion gases (soot, organic C or CO) and this information is used for generating a control signal 17 for the post combustion chamber burners 12, wherein basically the addition of an oxygen containing gas and/or fuel is controlled. In this configuration, the control system has sufficient time for the conversion of the signals, which corresponds to the travel time of the exhaust gases from the combustion chamber 1 to the effective range 11 (depending on the embodiment a few seconds, preferably between 1 and 5 seconds).

A generation of soot during the combustion of packages results in a clouding of the combustion chamber 1 and consequently in a decrease of the light intensity at the sensor. The gain, the offset and the integration of the sensor are adjusted to maximum detection speed in order to provide for a fast response of the control signal. But other optical measuring device (emission- and absorption measuring devices/IR, VIS or UV) however, may also be used if they are capable of providing for a fast response.

The control signals 17 are supplied to the automation control unit (SPS) of the control system TELEPERM (Process control unit 16) for the control of the plant and are processed therein (See FIG. 1). The essential dynamic functional components are processed in this control unit in a cycle of 400 ms. As a result, the reaction time of the control system is greater or equal to 400 ms. In order to ensure this, in the implementation, the functions which are not time-critical have been separated from the time-critical functions. The system has been re-configured and the sensing and the displacement times were optimized.

Figure 2:
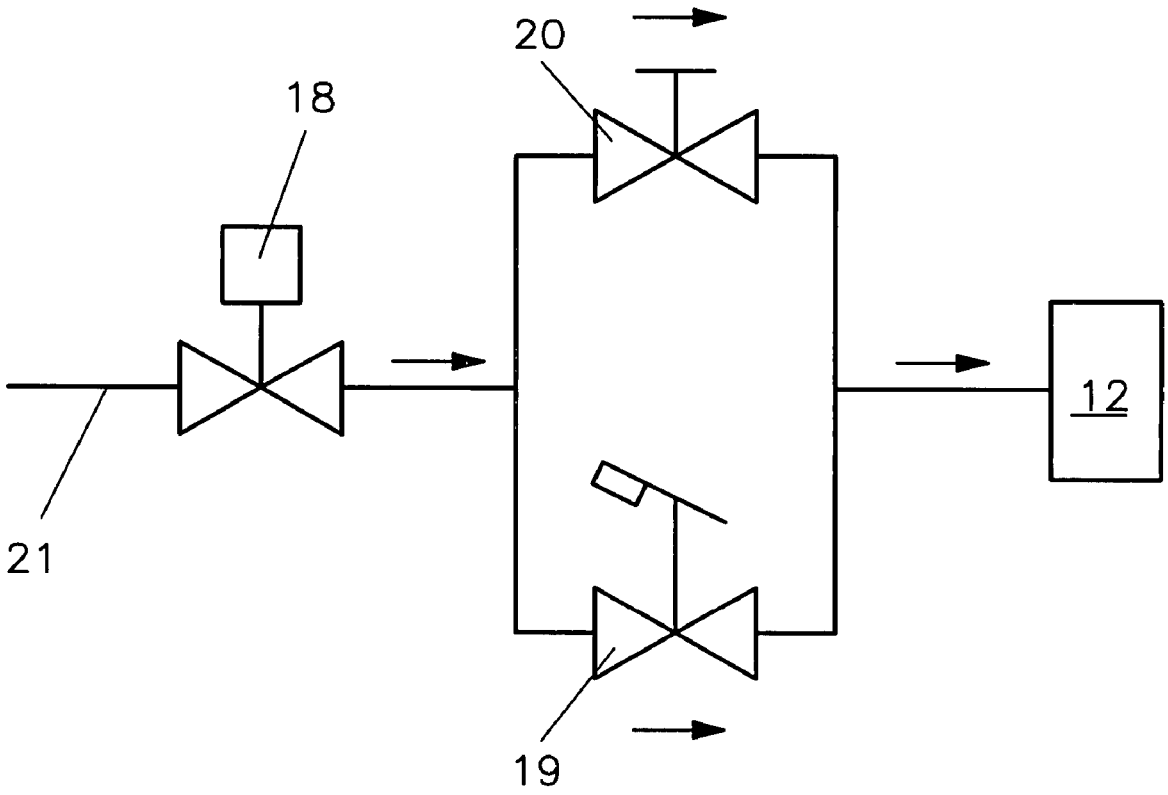
FIG. 2 shows the arrangement of the valves in the fuel supply line for a post-combustion chamber burner.

FIG. 2 shows an arrangement for the valves of the post combustion chamber burners 12. Since the closing periods for the control valves 18 of the post combustion burners 12 do not reach the needed speed, two additional control valves (rapid shut off valve 19 and minimal flow control valve 20) were added to the fuel supply line 21 (see FIG. 2). All three valves are controlled via the process control unit 16 by way of control signals 17. With a hysteresis function, the threshold value for initiation and the threshold value for resetting of the control can be provided. An initiation of the control results in switching off the supply of the main fuel flow to the two post combustion chamber burners by way of the rapid shutoff valve 19. The air supply volume and an adjustable minimal flow control valve 20 remain constant. The oxygen enrichment achieved thereby in the post combustion chamber provides for a burn off of the toxic components soot, organic C and CO, whereby the emission limit values can be maintained and, at the same time, the material flow through the plant can be increased. In order to prevent oscillation of the control valve 18, the control valve 18 is taken out of the control loop and set to a constant flow volume when the control is operated by the process control system. For optimization, a time point control arrangement is replaced by rapid response control valves which provide for finely adjustable control steps.

The control of the reduction of CO peaks (CO concentration maxima) comprises an optical measuring unit using video-optical imaging for the detection of the package burnout (sensor unit 13), the processing of the optical measuring signal 15 in the process control system 16 of the combustion plant by image processing based on an evaluation of digital color or, respectively, gray values to provide control signals 17 and a hardware-side valve arrangement in the fuel supply line 21 of the post combustion chamber 12 in accordance with FIG. 2.

EXAMPLES

Figure 3A:
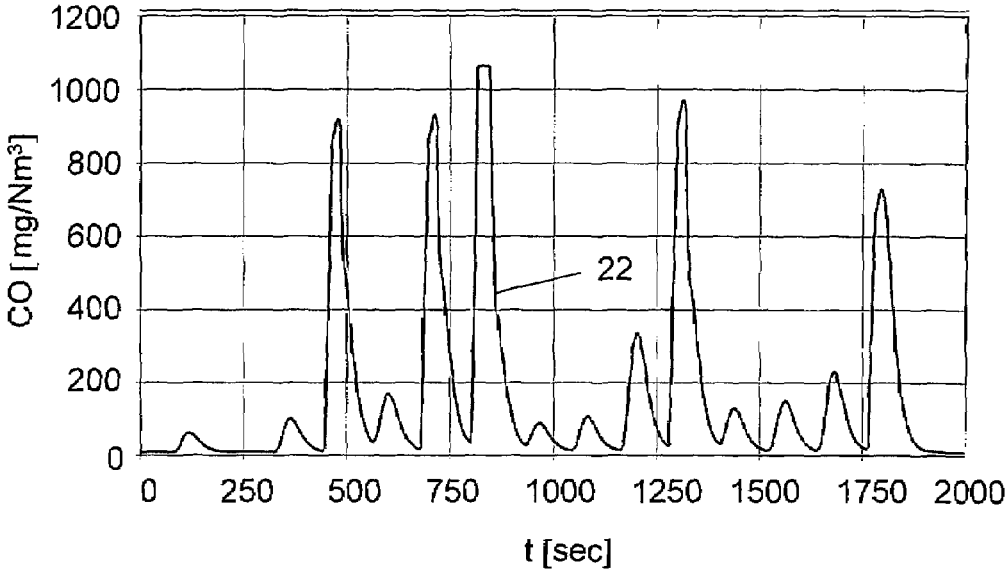
FIGS. 3*a* to FIG. 3*d* show the results of an exemplary embodiment with reduced CO peaks during the combustion of packages in the rotary kiln without (3*a* and 3*b*) and with (3*c* and 3*d*) control of the combustion conditions on the basis of in-situ measurement of the combustion process.
Figure 3B:
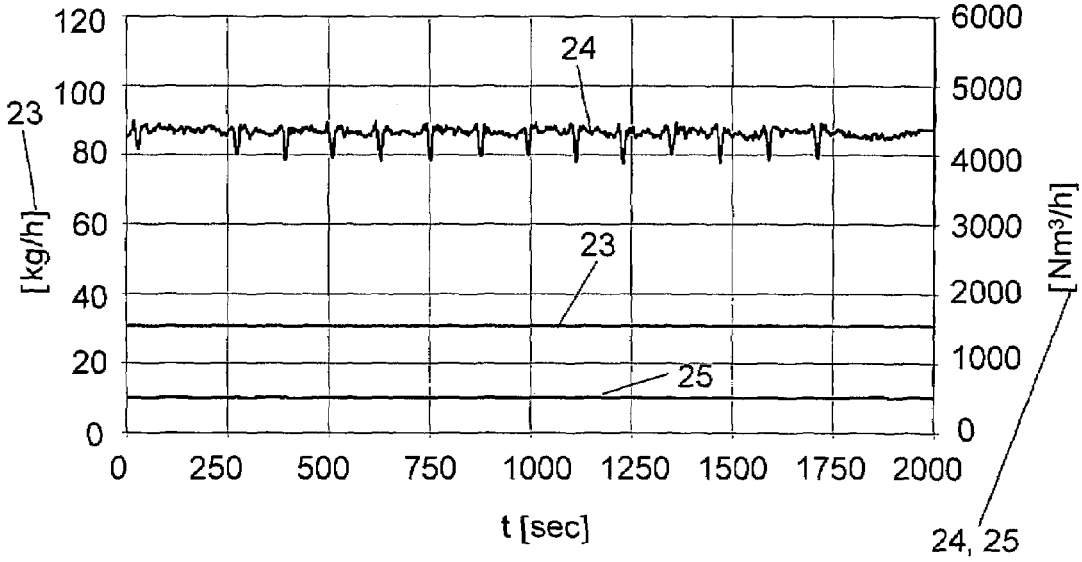
Figure 3C:
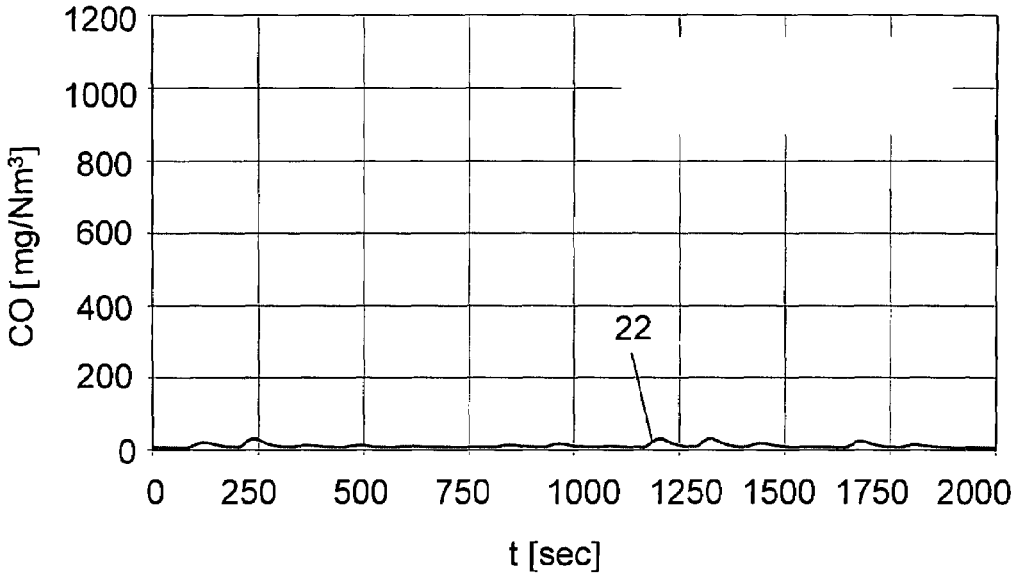
Figure 3D:
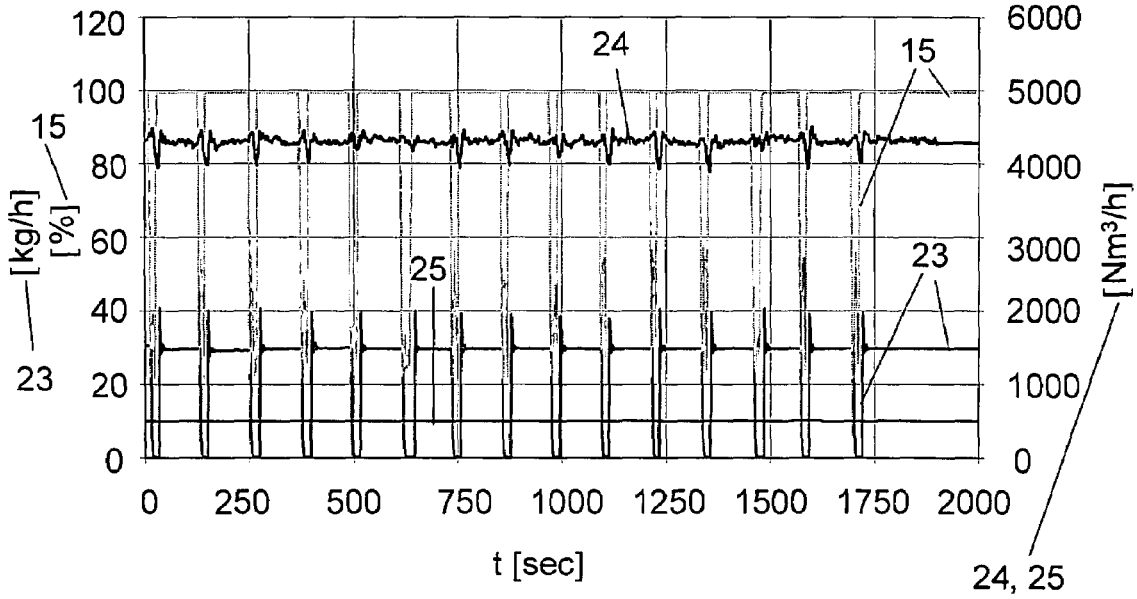

Based on an actual operation of the experimental plant THERESA, a reduction of CO peaks during package combustion in the rotary tube was achieved. The operational settings for the combustion chamber (rotary tube) and the post combustion chamber were the same in both experiments (Heating oil flow: 120 kg/h; combustion air flow 2200 $Nm^3/h$; package throughput: 30/h each including 1 liter heating oil EL). FIG. 3*a* to 3*d* show the result in diagrams with the same time window (running time), wherein FIGS. 3*a* and 3*b* show the result in diagrams with the same time window (running time), wherein FIGS. 3*a* and 3*b* show the results without, and FIGS. 3*c* and 3*d* show the results with, the control of the combustion process in accordance with the invention.

FIGS. 3*a* and 3*c* are directly comparable (measuring range and resolution). They show the CO concentration curve 22 in the purified gas in the chimney with the introduction into the combustion chamber of 1.0 liter packages of heating oil EL plotted in each case over the tune t, wherein a package was introduced every two minutes (see peaks of the measuring signals 15 in FIG. 3*d* and the exhaust gas volume flow 24 in FIGS. 3*b* and 3*d*. The mean CO concentrations are 180 $mg/Nm^3$ without and 11 $mg/Nm^3$ with the control of the combustion process in accordance with the invention (Reduction of the CO concentration above 90%) wherein the CO concentration peaks visible in FIG. 3*a* were practically fully suppressed with the method according to the invention.

FIGS. 3*b* and 3*d* are also directly comparable with each other (measuring range and resolution) and show for the same operational experiments the uncontrolled (FIG. 3*b*) and the controlled (FIG. 3*d*) heating oil input 23 to the post combustion burners with the introduction of 1.0 liter packages of heating oil EL plotted in each case over the time t. The controlled heating oil input is directly coupled to the measuring signal 15 shown in FIG. 3*d* and follows that signal with minimal delay. In contrast, the burner air supply 25 and the exhaust gas volume flow 24, both shown in FIG. 3*b* and FIG. 3*d* do not show any effects of the control of the combustion process.

The test results can be summarized as follows:

- safe maintenance of the emission limit values during the combustion of packages with high calorie waste
- reduction of the CO concentration in the chimney of better than 90%
- increased flow of packages with high calorie waste in the rotary tube depending on the tact time of the packages at least by a factor of 3.

The exemplary embodiment of the process shows that, with a package supply to the rotary tube and, in connection therewith, the additional combustion of packages in the rotary tubes, in spite of the increased thermal rotary tube load, substantial increases are possible as shown by the experiments. With a burner control in the post combustion chamber, CO emission values can be achieved (11.5 mg CO/$Nm^3$), which are clearly below the emission limits according to 17.BImSchV (day-average value 50 mg CO/$Nm^3$).

What is claimed is:

1. A method for increasing the throughput of packages in a rotary kiln including a rotary tube (4) forming a combustion chamber (1), a post combustion chamber (2) disposed in communication with an outlet end of the rotary tube (4), said post combustion chamber (2) being provided with at least one after burner (12), at least one gas supply connected to the at least one after burner (12), and an exhaust gas duct (3) in communication with the post combustion chamber (2), said method comprising the following steps:

a) introducing packages of waste material and oxygen containing gas into the combustion chamber (1), b) burning the packages with oxygen containing gas in the rotating tube (4) to form a combustion gas, c) discharging the combustion gas from the combustion chamber (4) to the post combustion chamber (2) for after combustion therein, and d) maintaining the combustion progress by optical sensor measurements in the rotary tube (4) so as to provide sensor values which are used for controlling the combustion conditions in the rotary tube (4) and in the post-combustion chamber (2) by controlling the fuel supply to the at least one burner in the post combustion chamber (1).

2. The method according to claim 1, wherein the sensor measurements comprise a soot concentration measurement via one of emission determination and optical transmission measurements.

3. The method according to claim 2, wherein emissions are determined by measuring a decrease of the flame radiation using at least one of a photodiode and an infrared camera.

4. The method according to claim 1, wherein the carbon dioxide concentration is measured by one of absorption and emission measurements.

5. The method according to claim 1, wherein oxygen, carbon dioxide or water content concentration are measured by one of absorption and emission determinations.

6. The method according to claim 1, wherein measurements are performed by a video optical imaging and image processing based on evaluation of digital color or, respectively, gray values.

7. The method according to claim 1, wherein the combustion conditions are controlled taking the combustion conditions in the rotary tube into consideration.

8. The method according to claim 7, wherein combustion material supply to the rotary tube and fuel supply to the after burner (12) is controlled by the control unit.

9. The method according to claim 8, wherein the fuel is gas and the control comprises the control of the gas supply.

* * * * *